US006422848B1

(12) United States Patent
Allen et al.

(10) Patent No.: US 6,422,848 B1
(45) Date of Patent: Jul. 23, 2002

(54) MODULAR MELTBLOWING DIE

(75) Inventors: Martin A Allen, Dawsonville; Joel E. Saine, Dahlonega, both of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/413,760

(22) Filed: Oct. 7, 1999

Related U.S. Application Data

(63) Continuation of application No. 09/153,903, filed on Sep. 16, 1998, now abandoned, which is a continuation-in-part of application No. 09/104,505, filed on Jun. 25, 1998, now abandoned, which is a continuation of application No. 08/820,559, filed on Mar. 19, 1997, now abandoned.

(51) Int. Cl.[7] ..... D01D 5/12
(52) U.S. Cl. ..... 425/7; 425/72.2; 425/83.1
(58) Field of Search ..... 425/7, 72.2, 83.1, 425/192 R

(56) References Cited

U.S. PATENT DOCUMENTS

| | | | | |
|---|---|---|---|---|
| 3,577,198 | A | 5/1971 | Beam | |
| 3,849,241 | A | 11/1974 | Butin et al. | 161/169 |
| 3,911,161 | A | 10/1975 | Nord et al. | 427/483 |
| 3,939,800 | A | 2/1976 | Banker | 118/636 |
| 3,970,417 | A | 7/1976 | Page | 425/72 |
| 4,142,010 | A | 2/1979 | Pipkin et al. | 427/355 |
| 4,478,624 | A | 10/1984 | Battigelli et al. | 425/7 |
| 4,513,683 | A | 4/1985 | Kisler | 118/620 |
| 4,720,252 | A | 1/1988 | Appel et al. | 425/80.1 |
| 4,749,125 | A | 6/1988 | Escallon et al. | 239/3 |
| 4,785,996 | A | 11/1988 | Zeicker et al. | 239/298 |
| 4,815,660 | A | 3/1989 | Boger | 239/8 |
| 4,818,463 | A | 4/1989 | Buehning | 264/40.1 |
| 4,830,872 | A | 5/1989 | Grenfell | 427/30 |
| 4,844,003 | A | 7/1989 | Slautterback et al. | 118/323 |
| 4,891,249 | A | 1/1990 | McIntyre | 427/421 |
| 4,904,174 | A | 2/1990 | Moosmayer et al. | 425/174.8 |
| 4,949,668 | A | 8/1990 | Heindel et al. | 118/314 |
| 4,983,109 | A | 1/1991 | Miller et al. | 425/7 |
| 5,085,891 | A | 2/1992 | Evans | 427/277 |
| 5,086,973 | A | 2/1992 | Escallon et al. | 239/3 |
| 5,122,048 | A | 6/1992 | Deeds | 425/174.8 |
| 5,145,689 | A | 9/1992 | Allen et al. | 425/72.2 |
| 5,160,746 | A | 11/1992 | Dodge et al. | 425/7 |
| 5,332,154 | A | 7/1994 | Maier et al. | 239/3 |
| 5,382,312 | A | 1/1995 | Raterman | 156/500 |
| 5,441,204 | A | 8/1995 | Tappel et al. | 239/708 |
| 5,552,012 | A | 9/1996 | Morris et al. | 156/272.4 |
| 5,618,566 | A * | 4/1997 | Allen et al. | 425/72.2 |
| 5,679,379 | A | 10/1997 | Fabbricante et al. | 425/192.5 |
| 5,700,322 | A | 12/1997 | Fort | 118/50 |
| 5,728,219 | A | 3/1998 | Allen et al. | 118/315 |
| 5,882,573 | A | 3/1999 | Kwok et al. | 264/510 |
| 5,902,540 | A | 5/1999 | Kwok | 264/555 |
| 5,904,298 | A | 5/1999 | Kwok et al. | 239/135 |
| 6,210,141 | B1 * | 4/2001 | Allen | 425/72.2 |

FOREIGN PATENT DOCUMENTS

| | | |
|---|---|---|
| DE | 8534594.6 | 3/1986 |
| EP | 0194074 A1 | 9/1986 |
| EP | 0578119 A1 | 1/1994 |
| EP | 0866152 A1 | 9/1998 |
| WO | WO 96/34132 | 10/1996 |

* cited by examiner

*Primary Examiner*—Robert Davis
*Assistant Examiner*—Joseph Leyson
(74) *Attorney, Agent, or Firm*—Wood, Herron & Evans, L.L.P.

(57) ABSTRACT

A meltblowing die includes a die tip having an outwardly projecting triangular nosepiece defining an apex therealong, a row of hot melt holes spaced along the apex, and air holes positioned in relation to the hot melt holes to cause at least some of the filaments discharging therefrom to flare outwardly so that the hot melt filaments deposited on an underlying moving substrate has a lateral dimiension greater than the length of the row of hot melt holes. The die may be operated to cause the filaments to be deposited on the substrate in a side-by-side sinusoidal, stitch-like pattern.

3 Claims, 7 Drawing Sheets

FIG-2
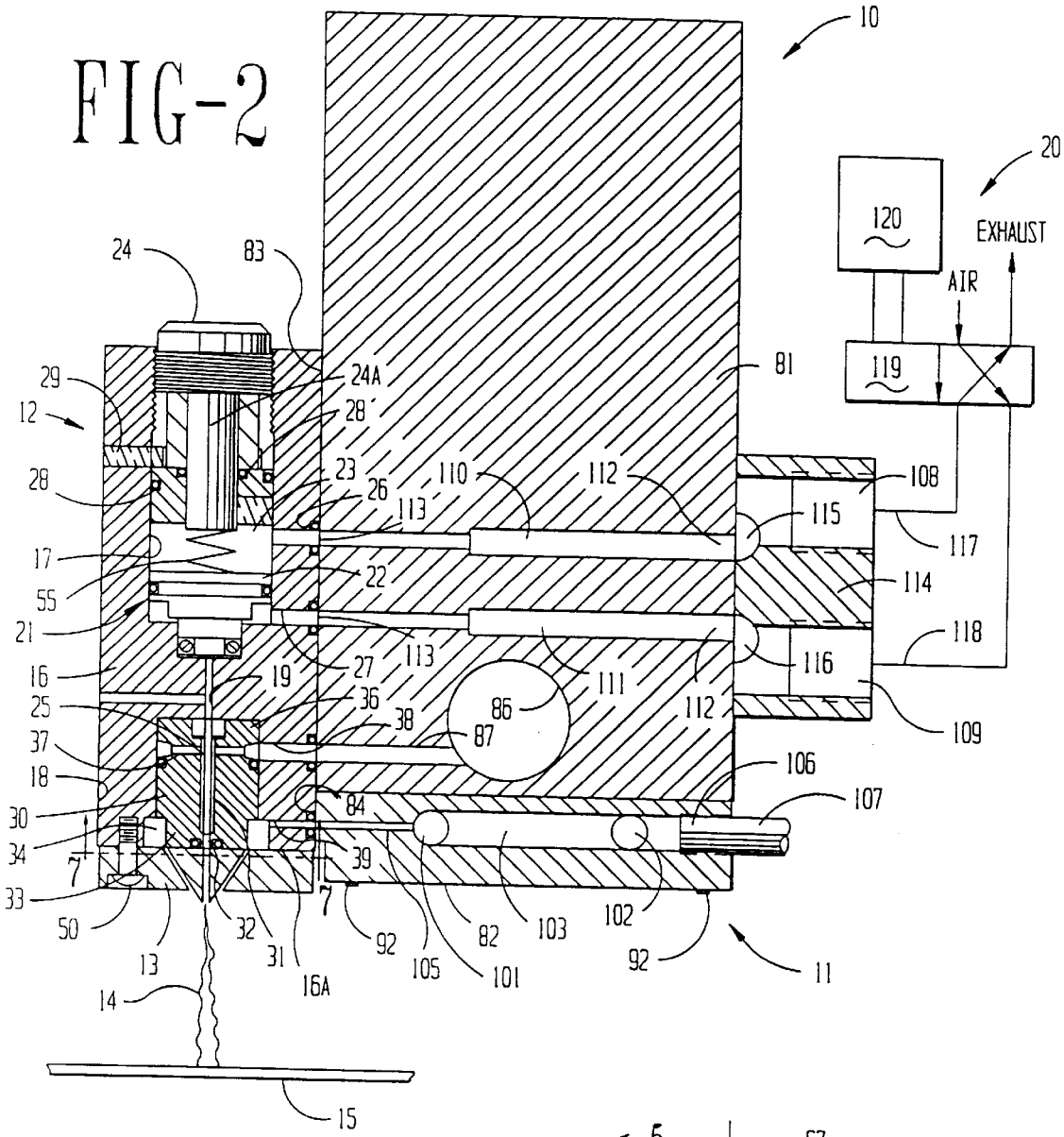
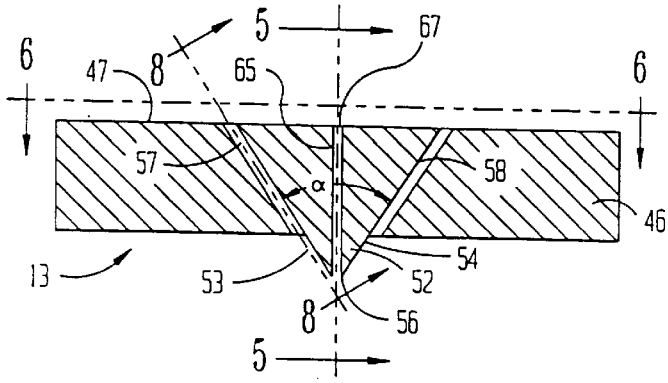
FIG-3

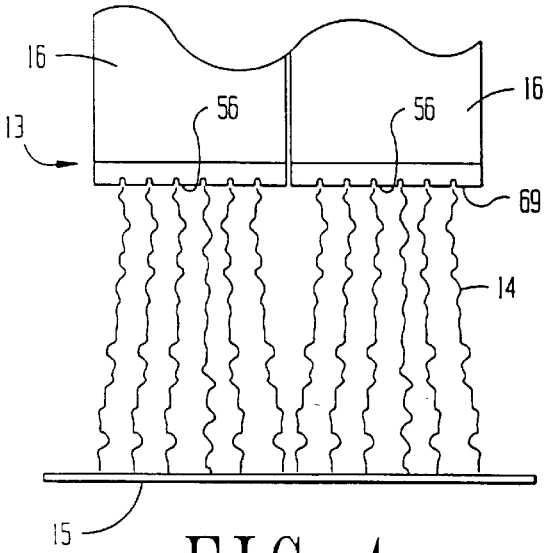
FIG-4
FIG-7
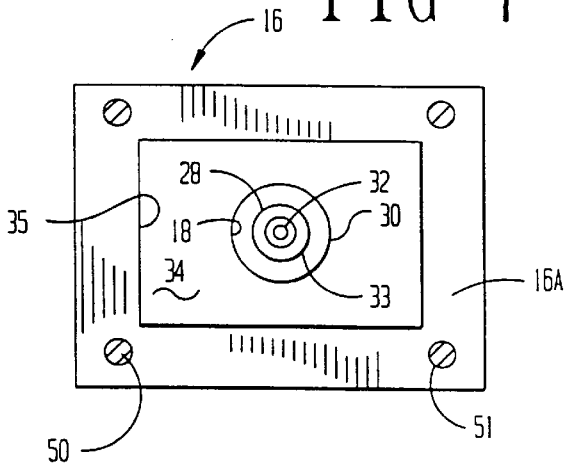
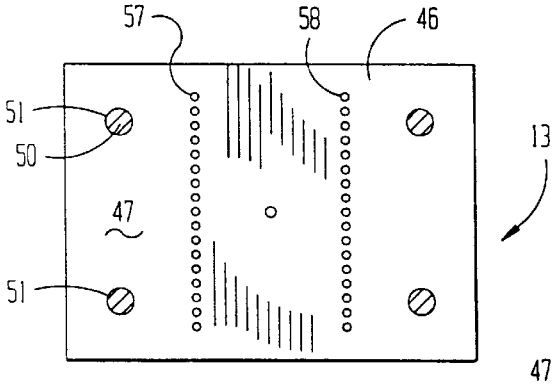
FIG-6
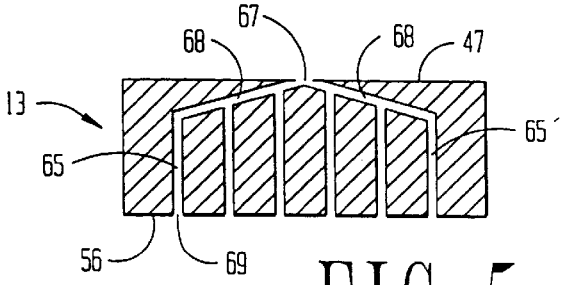
FIG-5
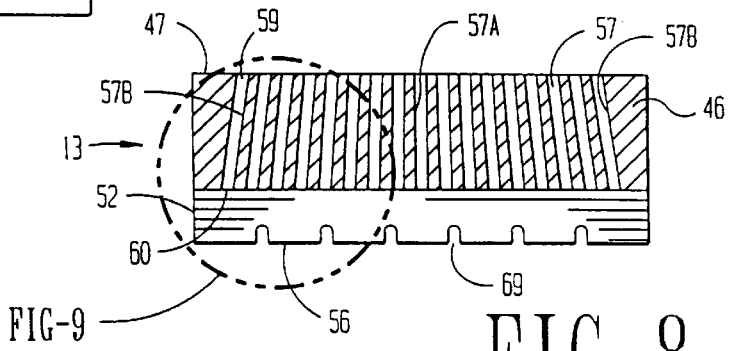
FIG-8

FIG-10
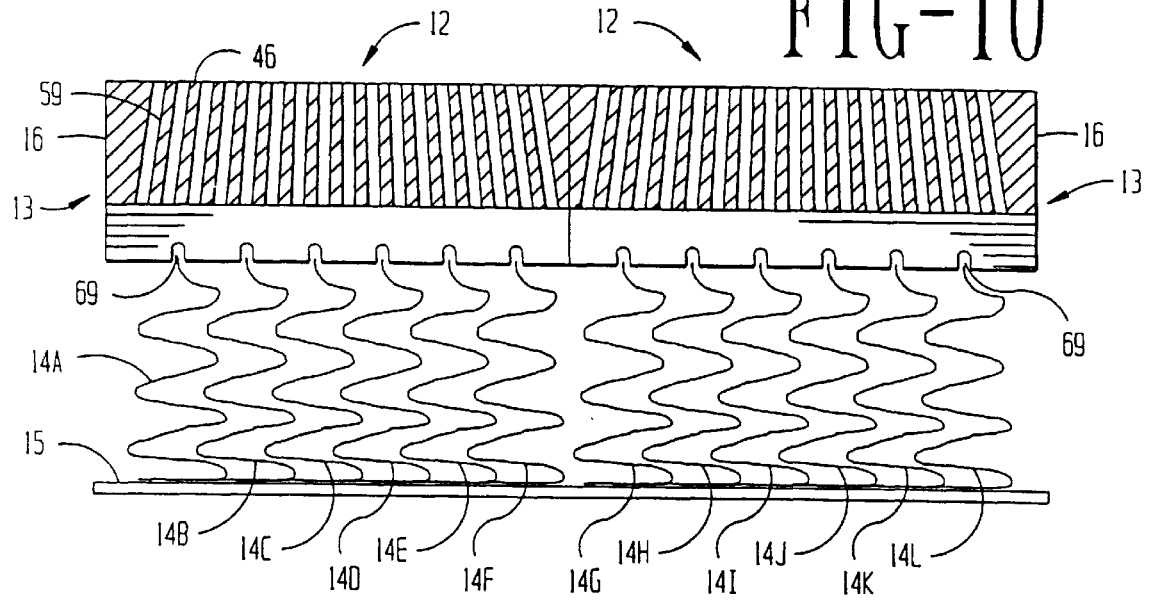
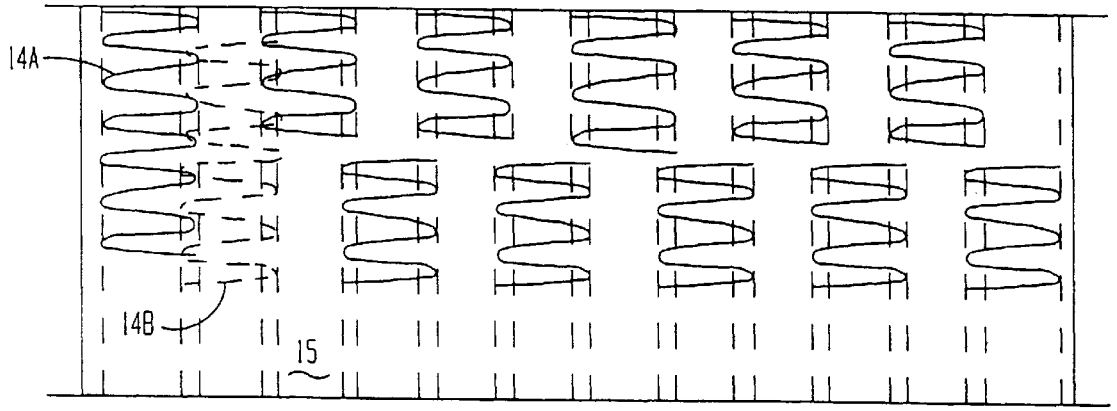
FIG-11
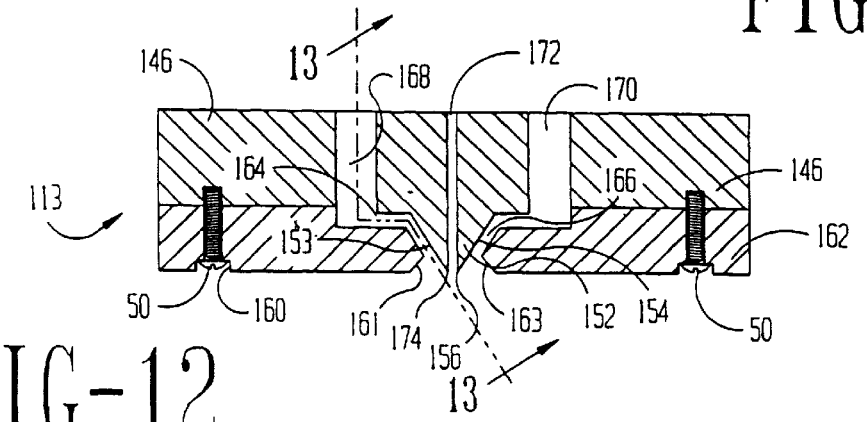
FIG-12

MODULAR MELTBLOWING DIE

RELATED APPLICATION

This is a continuation of U.S. patent application Ser. No. 09/153,903 filed Sep. 16, 1998, now abandoned, which is a continuation-in-part of U.S. patent application Ser. No. 09/104,505 filed Jun. 25, 1998, now abandoned, which is a continuation of U.S. patent application Ser. No. 08/820,559, filed Mar. 19, 1997, now abandoned.

BACKGROUND OF THE INVENTION

This invention relates generally to a meltblowing die system. In one aspect the invention relates to a meltblowing die comprising a plurality of self-contained, interchangeable modular units. In another aspect, the invention relates to a meltblowing die for meltblowing polymer onto a substrate or collector wherein the deposition pattern is wider than the effective length of the die. In still another embodiment, the present invention relates to a modular meltblowing die wherein adhesive is deposited uniformly across a substrate.

Meltblowing is a process in which high velocity hot air (normally referred to as "primary air") is used to blow molten fibers extruded from a die onto a collector to form a web, or onto a substrate to form a coating or composite. The process employs a die provided with (a) a plurality of openings (e.g. orifices) formed in the apex of a triangular shaped die tip and (b) flanking air passages. As extruded rows of the polymer melt emerge from the openings, the converging high velocity air from the air passages contacts the filaments and by drag forces stretches and draws them down forming microsized filaments. The microsized filaments are deposited in a random or uniform pattern on a collector or substrate.

In some meltblowing dies, the openings are in the form of slots. Generally, however, the die openings are in the form of orifices. In either design, the die tips are adapted to form a row of filaments which upon contact with the converging sheets of air are carried to and deposited on a collector or a substrate in a random or uniform manner.

Meltblowing technology was originally developed for producing nonwoven fabrics but recently has been utilized in the meltblowing of adhesives onto substrates. In meltblowing adhesives, the filaments are drawn down to their final diameter of 5 to 200 microns, preferably 10 to 100 microns, and are deposited at random or uniformly on a substrate to form an adhesive layer thereon onto which may be laminated another layer such as film or other types of materials or fabrics.

In the meltblowing of polymers to form nonwoven fabrics (e.g. webs), the polymers, such as polyolefin, particularly polypropylene, are extruded as filaments and drawn down to an average fiber diameter of 0.5 to 10 microns and deposited at random on a collector to form a nonwoven fabric. The integrity of the nonwoven fabric is achieved by fiber entanglement with some fiber-to-fiber fusion. The nonwoven fabrics have many uses including oil wipes, surgical gowns, masks, filters, etc.

The filaments extruded from the meltblowing die may be continuous or discontinuous. For the purpose of the present invention, the term "filament" is used interchangeably with the term "fiber" and refers to both continuous and discontinuous strands.

The meltblowing process grew out of laboratory research by the Navel Research Laboratory which was published in Navel Research Laboratory Report 4364 "Manufacture of Superfine Organic Fibers," Apr. 15, 1954. Exxon Chemical developed a variety of commercial meltblowing dies, processes, and end-use products as evidenced by U.S. Pat. Nos. 3,650,866, 3,707,198, 3,755,527, 3,825379, 3,849,241, 3,947,537 and 3,978,185. Representative meltblowing patents of other companies (e.g. Beloit and Kimberly Clark) include U.S. Pat. Nos. 3,942,723, 4,100,324, and 4,526,733. More recent meltblowing die improvements are disclosed in U.S. Pat Nos. 4,818,463 and 4,889,476.

U.S. Pat. Nos. 5,145,689 and 5,236,641 each disclose a meltblowing die constructed in side-by-side units with each unit having separate polymer flow systems including internal valves.

As noted above, meltblowing is also used in the application of hot melt adhesives to substrates. Air assisted dies used in applying hot melt adhesives include mainly spiral dies and meltblowing dies. Spiral dies are disclosed in U.S. Pat. Nos. 4,785,996, and 4,983,109.

SUMMARY OF THE INVENTION

The meltblowing die of the present invention may be modular in structure, comprising a plurality of self-contained meltblowing modules. The modules are mounted in side-by-side relationship on a manifold so that the length of the die can be varied by merely adding modules to, or removing modules from, the structure. In a preferred embodiment, the modules are interchangeable and each includes an internal valve for controlling polymer flow therethrough.

The modular meltblowing die comprises a manifold and plurality of modules mounted on the manifold. The manifold has formed therein polymer flow passages for delivering a hot melt adhesive polymer to each module and hot air flow passages for delivering hot air to each module.

Each module includes a body, a die tip, and polymer and air flow passages for conducting hot melt adhesive and hot air from the manifold through each module.

In a preferred embodiment, the die tip of each module comprises (a) a triangular nosepiece terminating in an apex and polymer discharge means (i.e. fiber forming means) at the apex for discharging a row of closely spaced fibers, and (b) two rows of air passages flanking the row of fiber forming means. The fiber forming means may be in the form of an elongate slot or slots but preferably is in the form of a row of orifices. In either design a row of fibers are discharged from the die.

Hot air which flows through the manifold and each module is discharged as two rows of converging hot air streams at or near the apex. The polymer melt (such as hot melt adhesive) flows through the manifold and each module and discharges as a plurality of fibers into the converging air streams. The air streams contact and draw down the fibers depositing them as random fibers onto a collector or a substrate.

The air passages flanking the row orifices are shaped and positioned in relation thereto so that the discharging air streams contact opposite sides of the row of fibers and causes, at least some of the filaments, to flare out longitudinally in relation to the row of orifices. The pattern of fiber deposition on the substrate thus has a lateral dimension larger than the length of the row of orifices.

In a preferred embodiment, the air passages are in the form of air holes drilled in the die. The flanking air passages thus comprise two rows of converging air holes which lie in converging planes which intersect at or near the nosepiece apex. The converging planes define an included angle of between above 60°–90°. The air hole design eliminates the need for air plates commonly used in meltblowing dies and thus represents a significant improvement over conventional meltblowing die designs.

A particularly advantageous feature of the modular die construction of the present invention is that it offers a highly versatile meltblowing die. The die tip is the most expensive component of the die, requiring extremely accurate machining (a tolerance of 0.0005 to 0.001 inches on die tip dimensions is typical). The cost of long dies is extremely expensive (on the order of $1,300/inch). By employing the modules, which are relatively inexpensive ($300/inch), the length of the die can economically be extended to lengths of 200 or more inches. The air hole design permits controlled deposition of the fibers along the die length.

Another advantageous feature of the modular die construction is that it permits the repair or replacement of only the damaged or plugged portions of a die tip. With continuous die tips of prior art constructions, even those disclosed in U.S. Pat. No. 5,145,689, damage to or plugging of the die tip requires the complete replacement, or at least removal, of the die tip. With the present invention, only the damaged or plugged module needs replacement or removal which can be done quickly which results in reduced equipment and service costs. Another advantage of the preferred die constructed according to the present invention is as noted above, expensive and troublesome (e.g. plugging) air plates are not needed.

A still further advantage of the invention is the ability of the die to deposit the adhesive uniformly across on the substrate a plurality of modules. The outwardly flaring of the filaments permits the adhesive to deposit on the substrate in a lateral spacing, greater than the length of the row of orifices. With modular die tips, thus permits the orifice spacing on the die tip to be smaller than the spacing of prior art modular designs and still retain uniform properties across the length of the die. Also, the orifices at each end of the row of orifices receive more process air than those of the prior art designs.

As demonstrated in Example I, the die constructed according the present invention can be operated to deposit hot melt adhesive filaments onto a substrate in a sinusoidal pattern resembling a sewing stitch. There are many advantages of the sinusoidal pattern, including (1) less air consumption, (2) better edge control, (3) more defined patterns, and (4) forecastable bond strengths, among others.

In another embodiment of the die constructed according to the present invention, the air passages are positioned on the apex of the die adjacent the polymer passages instead of flanking the air passages. (The terms "polymer orifices", "polymer passages" and "polymer holes" when referring to polymer filaments extruded from the die tip are used interchangeably herein.)

In this alternate embodiment, the sinusoidal pattern can be better controlled by positioning the air passages in relation to the polymer passages.

Although the principles involved in attaining the sinusoidal, stitch-like pattern of hot melt deposition are not fully understood, it has been demonstrated that this pattern can be achieved by all of the die designs disclosed herein. It is believed that the sinusoidal stitch-like pattern is caused by combination of the following forces: (a) viscous drag forces (in the direction of air flow), (b) the aerodynamic drag force caused by the non-parallel air flowing around the filaments, and (c) lift forces (in a direction normal to the air flow). These forces can be controlled to cause the filaments to oscillate in the cross or transverse direction in relation to substrate movement and cause the filaments to be deposited in a sinusoidal, stitch-like pattern.

BRIEF DESCRIPTION OF THE DRAWINGS

FIG. 2 is an enlarged sectional view of the die shown in FIG. 1 with the cutting plane taken along line 2—2 of FIG. 1.

FIG. 3 is an enlarged view of the die tip shown in FIG. 2.

FIG. 4 is an enlarged front elevation view of two modules of the die shown in FIG. 1, illustrating the fiber discharge from adjacent modules.

FIG. 5 is a cross sectional view of the die tip shown in FIG. 3 with the cutting plane taken along line 5—5 thereof.

FIG. 6 is a bottom elevation view of the die tip shown in FIG. 3, shown from the perspective of the plane indicated by line 6—6 thereof.

FIG. 7 is a bottom view of the die body shown in FIG. 2 with the cutting plane along line 7—7 thereof.

FIG. 8 is enlarged sectional view of the die tip shown in FIG. 3, with the cutting plane taken along line 8—8 thereof.

FIG. 10 is a cross sectional view of the two side-by-side module, each constructed according to the embodiment illustrated in FIGS. 1–9, and showing the side-by-side sinusoidal deposition of hot melt filaments onto a substrate.

FIG. 11 is a top plan view of a substrate illustrating the side-by-side sinusoidal patterns of the hot melt filaments deposited by the modules shown in FIG. 10.

FIG. 12 is a cross sectional view of another embodiment of a die tip (with air plates) useable in the die assembly of the present invention.

DESCRIPTION OF THE PREFERRED EMBODIMENTS

Figure 1:
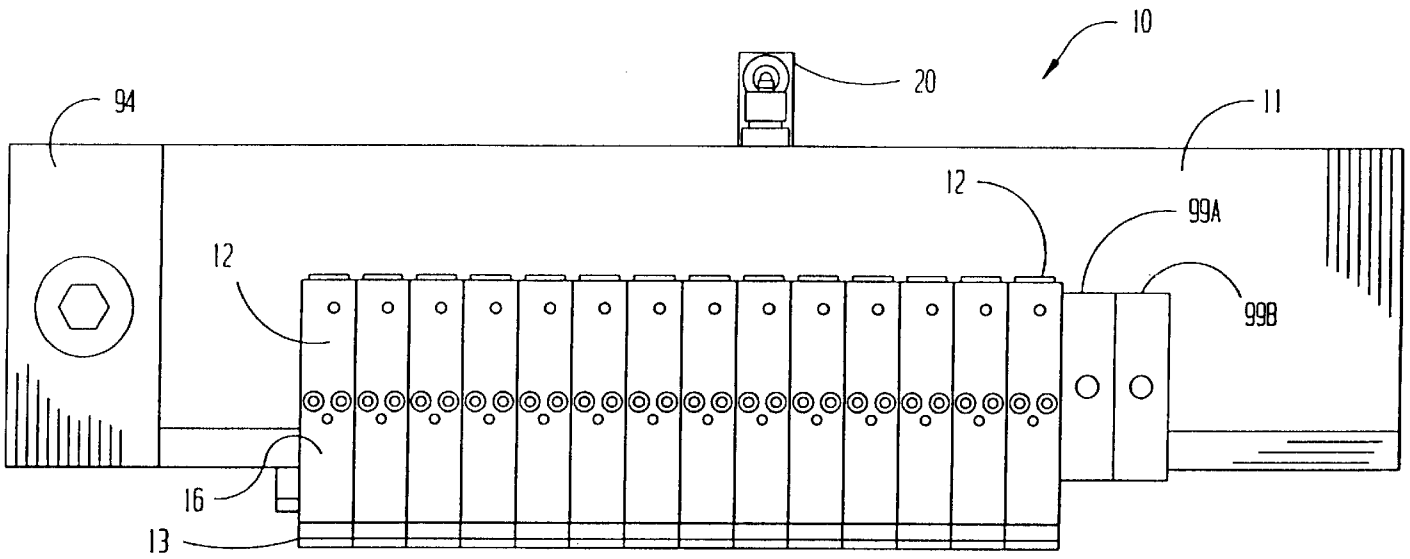
FIG. 1 is a front elevation view of a meltblowing modular die constructed according to the present invention.

With reference to FIGS. 1 and 2, a modular meltblowing die assembly 10 of the present invention comprises a manifold 11, a plurality of side-by-side self contained die modules 12, and a valve actuator assembly (including actuator 20) or controlling the polymer flow through each module. Each module 12 includes a die body 16 and a die tip 13 for discharging a plurality of fibers 14 onto a substrate 15 (or collector). The manifold 11 distributes a polymer melt and hot air to each of the modules 12. Each of these components is described in detail below.

Die Modules

As best seen in FIG. 2, die body 16 has formed therein an upper circular recess 17 and a low circular recess 18 which are interconnected by a narrow opening 19. The upper recess 17 defines a cylindrical chamber 23 which is closed at its top by threaded plug 24. A valve assembly 21 mounted within chamber 23 comprises piston 22 having depending therefrom stem 25. The piston 22 is reciprocally movable within chamber 23, with adjustment pin 24A limiting the upward movement. Conventional o-rights 28 may be used at the interface of the various surfaces for fluid seals as illustrated. Threaded set screws 29 may be used to anchor cap 24 and pin 24A at the proper location within recess 17.

Side ports 26 and 27 are formed in the wall of the die body 16 to provide communication to chamber 23 above and below piston 22, respectively. As described in more detail below, the ports 26 and 27 serve to conduct air (referred to as instrument gas) to and from each side of piston 22.

Referring to FIGS. 2 and 7, lower recess 18 is formed in a downwardly facing surface 16A of body 16. This surface serves as the mounting surface for attaching the die tip 13 to the die body 16. Mounted in the lower recess 18 is a threaded valve insert 30 having a central opening 31 extending axially therethrough and terminating in valve port 32 at its lower extremity. A lower portion 33 of insert member 30 is of reduced diameter and in combination with die body inner wall 35 define a downwardly facing cavity 34 best seen in FIG. 7. Threaded bolt holes 50A formed in the mounting surface 16A of the die body receive bolts 50. As described later, bolts 50 maintain the die tip 13 secured to the die body 16. Upper portion 36 of insert member 30 abuts the top surface of recess 18 and has a plurality (e.g. 4) of circumferential ports 37 formed therein and in fluid communication with the central passage 31. An annular recess extends around the upper portion 36 interconnecting the ports 37.

Valve stem 25 extends through body opening 19 and axial opening 31 of insert member 30, and is adapted to seat on valve port 32 (as illustrated in FIG. 2). The annular space between stem 25 and opening 31 is sufficient for polymer melt to flow therethrough. The lower end of stem 25 seats on port 32 with piston 22 in its lower position within chamber 23 as illustrated in FIG. 2. As discussed below, actuation of the valve moves the lower end of stem 25 away from port 32 (open position), permitting the flow of polymer melt through ports 37, through annular space, discharging through port 32 into the die tip 13. Conventional o-rings may be used at the interface of the various surfaces as illustrated in the drawings.

As shown in FIG. 3, the die tip 13 comprises a base member 46 which is generally coextensive with the mounting of surface 16A of die body 16, and a triangular nosepiece 52 which may be integrally formed with the base 46. The nosepiece 52 is defined by converging surfaces 53 and 54 which meet at apex 56. The apex 56 may be discontinuous, but preferably is continuous along the die 10. The height of the nosepiece 52 may vary from 100% to 25% of the overall height of the die tip 13, but preferably is not more than 50% and most preferably between 20% and 40%.

The portions of the base 46 extending laterally outwardly from the nosepiece 52 serve as flanges for mounting the die tip 13 to the assembly and provide means for conducting air through the base 46. As best seen in FIG. 6, the flanges of the base 46 have two rows of air holes 57 and 58, and mounting holes 51 which register with the mounting holes 50 of the body 16.

The rows of air holes 57 and 58 formed in the die tip base 46 define converging planes. The plane defined by air holes 57 extends at the same angle as nosepiece surface 53, and the plane defined by air holes 58 extend at the same angle as nosepiece surface 54 (see FIG. 3). The included angles ($\alpha$) of the planes and surfaces 52 and 53 ranges from 30° to 90°, preferably from 60° to 90°. (It is to be understood that reference to holes lying in a plane means the axes of the holes lie in the plane.)

Figure 9:
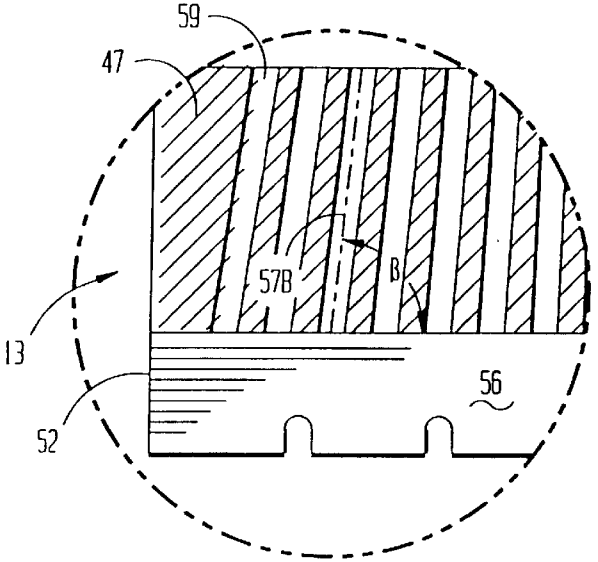
FIG. 9 is an enlarged, fragmentary view of FIG. 8 illustrating the angle β of the air holes in relation to the apex.

While each row of air holes 57 and 58 lie in their respective planes, at least some of the air holes 57 or 59 within their respective planes are not parallel. As best seen in FIGS. 8 and 9, the die tip 13 is provided with an odd number (e.g. 17) of air holes 57, each having an inlet 59 and an outlet 60. (Note the row of air holes 58, on the opposite side of the nosepiece 52 is preferably the mirror image of the row of orifices 57, although they need not be. For example the air holes 58 may be offset from air holes 52.)

The die tip 13 further includes surface 47 which is mounted on surface 16A of the die body 16, closing cavity 34. Surface 47 also seats on the downwardly facing surface of insert member 30, with o-ring providing a fluid seal at the junction of these two surfaces.

With the die tip 13 mounted on the die body 16 (see FIG. 2), the inlets 59 of all of the air holes 57 and 58 register with cavity 34 as shown in FIG. 2.

The central air holes (in this embodiment air hole 57A) extends perpendicular to the apex 56 as shown in FIG. 8. One or more air holes 57 located at the longitudinal center of the die tip 13 may extend parallel to air hole 57A. In designs with an even number of air holes 57, at least two of the parallel center air holes 57A are preferably provided.

The air holes 57 flanking the center air hole 57A form an angle $\beta$ (see FIG. 9) with the apex 56 which decreases progressively (arithmetic) and symmetrically from the center hold 57A outwardly. The outermost holes are shown as 57B on FIGS. 8 and 9. The air holes 57B form an angle with the apex 56 that decreases in constant increments outwardly. For example center air hole 57A forms an angle of 90° with the apex 56. If the angle increment is −1°, then the two air holes 57 adjacent air hole 57A forms an angle of 89° with the apex 56. Continuing the incremental arithmetic progression to the eighth (outermost) air holes 57B, the angle of these air holes would be 82°. Of course, the incremental angle may vary, but preferably is between ½ and 4°, most preferably between 1° and 3.5°. The arithmetic progression may be represented by the following equation:

$$\text{Angle } \beta = 90° - n\iota$$

Where n is the hole position or each side of the center air hole and preferably ranges from 4 to 15, most preferably 5 to 10 and $\iota$ is the constant incremental degree change.

For descriptive purposes, center air holes 58 are referred to as 58A and flanking air holes 58 are referred to as 58B.

Polymer passages 65 are formed in the die tip 13, as shown in FIGS. 3 and 5. The passages may be in the form of a distribution system comprising a plurality of passages 65 connected to inlet 67 by passage 68. Inlet 67 registers with die body port 32 with die tip 13 mounted on die body 16.

The passages 65 have outlets at 69 which are uniformly spaced along the apex 56. Passages 65 preferably extend perpendicular to apex 56. The design illustrated in FIG. 5 serves well for small modules (i.e. lengths less than about 3" to 4"). For longer dies, a pressure balance coathanger design may be preferred. The passages 65 are preferably small diameter orifices and serve as the fiber forming means. In an alternate embodiment, the fiber forming means may be in the form of a slot as described in U.S. patent application Ser. No. 5,618,566.

The Manifold

As best seen in FIG. 2, the manifold 11 is constructed in two parts: an upper body 81 and a lower body 82 bolted to the upper body by spaced bolts 92. The upper body 81 and lower body 82 have mounting surfaces 83 and 84, respectively, which lie in the same plane for receiving modules 12.

The upper manifold body 81 has formed therein polymer header passages 86 extending longitudinally along the interior of body 81 and side feed passages 87 spaced along the header passage 86 for delivering polymer to each module 12. The polymer feed passages 87 have outlets which register with passage 38 of its associated module 12. The polymer header passage 86 has a side inlet at one end of the body 81 and terminates at near the opposite end of the body 81. A connector block 94 (see FIG. 1) bolted to the side of body 81 has a passage for directing polymer from feed line to the header channel 86. The connector block 94 may include a polymer filter. A polymer melt delivered to the die 10 flows from-a source such as an extruder of metering pump through inlet passages to passage 86 and in parallel through the said feed passages 87 to the individual modules 12.

Valve and Instruments

Returning to FIG. 2, air is delivered to the modules through the lower block 82 of the manifold 11. The air passages in the lower block 82 are in the form of a network of passages comprising a pair of longitudinally extending passages 101 and 102, interconnecting side ports 103, and module air feed ports 105 longitudinally spaced along bore 101. Air inlet passage 106 connects to air feed line 107 near the longitudinal center of block 82. Air feed ports 105 register with air passage 39 of its associated module.

Heated air enters body 82 through line 107 and inlet 106. The air flows through passage 102, through side passages 103 into passage 101, and in parallel through module air feed ports 105 and module passages 39. The network design of manifold 82 serves to balance the air flow laterally over the length of the die 10.

The instrument air for activating valve 21 is delivered to the chamber 23 of each module 12 by air passages formed in the block 81 of manifold 11. As best seen in FIG. 2, instrument air passages 110 and 111 extend through the width of body 81 and each has an inlet 112 and an outlet 113. Outlet 113 of passage 110 registers with port 26 formed in module 12 which leads to chamber 23 above piston 22; and outlet 113 of passage 111 registers with port 27 of module 12 which leads to chamber 23 below piston 22.

An instrument air block 114 is bolted to block 81 and traverses the full length of the instrument air passages 110 and 111 spaced along body 81 (see FIG. 1). The instrument air block 114 has formed therein two longitudinal channels 115 and 116. With the block 114 bolted to body 81, channels 115 and 116 communicate with the instrument air passages 110 and 111, respectively. Instrument tubing 117 and 118 delivers instrument air from control valve 119 to flow ports 108 and 109 and passages 110 and 111 in parallel.

For clarity, actuator 20 and tubing 117 and 118 are shown schematically in FIG. 2. Actuator 20 comprises three-way solenoidal air valve 119 coupled with electronic controls 120.

The valve 21 of each module 12 is normally closed with the chamber 23 above piston 22 being pressurized and chamber 23 below piston 22 being vented through valve control 119. Spring 55 also acts to maintain the closed position. To open the valves 21 of the modules 12, the 3-way control valve 119 is actuated by controls 120 sending instrument gas through tubing 118, channel 116, through passage 111, port 27 to pressurize chamber 23 below piston 22 and while venting chamber 23 above piston 22 through port 26, passage 110, channel 115 and tubing 117. The excess pressure below piston 22 moves the piston and stem 25 upwardly opening port 32 to permit the flow of polymer to the die tip 13.

In the preferred embodiment all of the valves are activated simultaneously using a single valve actuator 20 so that polymer flows through all the modules 12 in parallel, or there is no flow at all through the die. In other embodiments, individual modules or groups of modules may be activated using multiple actuators 20 spaced along the die.

More details of the valve 21, manifold 11, and instruments are presented in U.S. Pat. No. 5,618,566, the disclosure of which is incorporated herein by reference.

Alternate Embodiment of Die Tips

Figure 13:
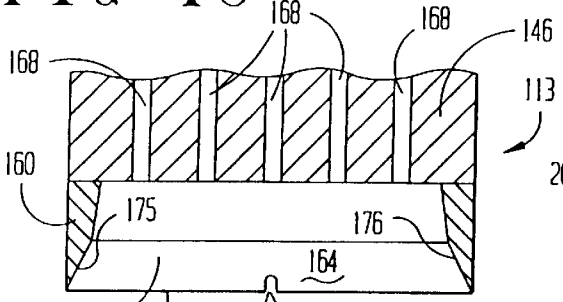
FIG. 13 is a sectional view of the die tip shown in FIG. 12 taken along line 11—11 thereof.

FIGS. 12 and 13 illustrate another embodiment of the invention wherein a die tip 113 is provided with air plates 160 and 162. As shown in FIG. 12, the die tip 113 is similar to the die tip 13 shown in FIG. 3, having a base member 146 which is generally coextensive with surface 16A of body 16, and a triangular nosepiece 152 defined by converging surfaces 153 and 154. Air plates 160 and 162 are mounted on the base 146 and, in combination with the nosepiece surface 153 and 154 define converging slits 164 and 166. The inner edges of the air plates 160 and 162 may be truncated as at 161 and 163 to avoid buildup of polymer.

With the die tip 113 mounted on die body 16 (FIG. 2), air passages 168 and 170 formed in the base member 146 deliver air to the converging slots 164 and 166 from air chamber 34 of the die body 16. A polymer passage 172 extends through the base member 146, in registry with port 32 of die body 16 and has an outlet 174 at the apex 156 of nosepiece 152. A polymer melt thus flows from port 32 through the die tip 113 discharged as filament 14 as shown in FIG. 13.

As shown in FIG. 13, the air slit 164 is defined by outwardly tapering end walls 175 and 176. This avoids the aerodynamic end wall effects of straight walls on the air and reduces air eddy currents. Slit 166 likewise has identical tapering end walls. The outward wall taper may be between about 10° to 15° with respect to the vertical and may extend from ¼ to 1½", preferably ½ to 1 inch of the width of air plate 160 or 162.

Although only one polymer hole 172 is illustrated in FIGS. 13, several such holes may distributed along the apex at a spacing of 2 to 50 holes per inch, preferably 4 to 10 holes per inch.

Figure 20:
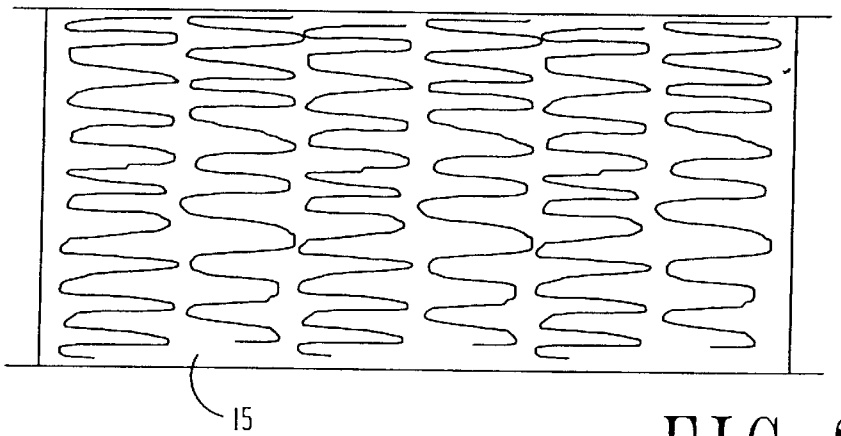
FIG. 20 is a top plan view of a substrate illustrating the pattern of the hot melt filaments deposited by the die tip shown in FIG. 19.
Figure 15:
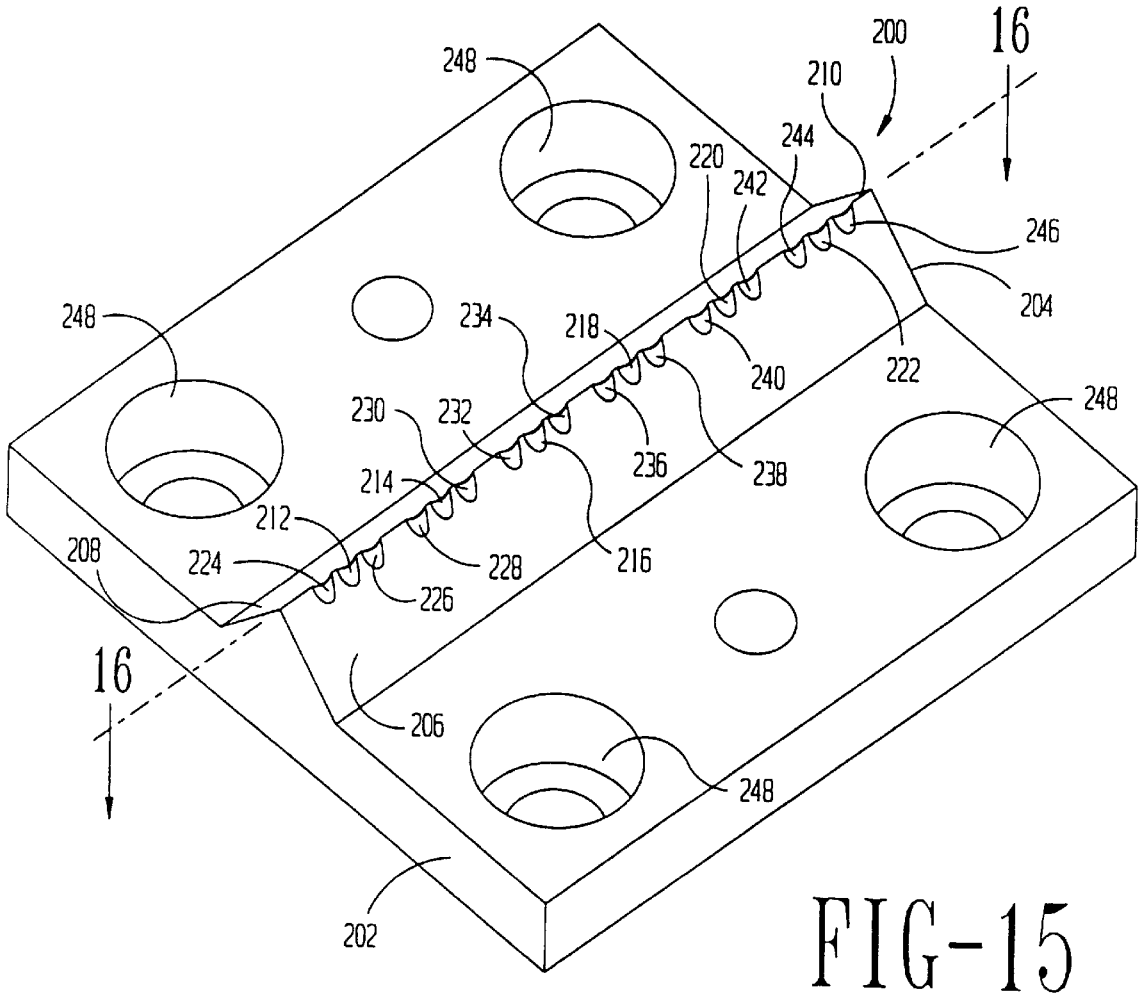
FIG. 15 is a perspective view of another embodiment of the die tip (shown inverted) constructed according to the present invention.

FIGS. 15, through 20, illustrate still another embodiment of the invention.

In this embodiment as best seen in FIG. 15, the die tip 200 comprises a base member 202 sized to mount on surface 16A of die body 16 and has a triangular nosepiece 204 projecting outwardly from the base member 202. The size and shape of the nosepiece 204 may be generally the same as nosepiece 52 shown in FIG. 3. Nosepiece 204 is defined by converging surfaces 206 and 208 meeting at apex 210.

A salient difference between the embodiment illustrated in FIGS. 15–20 and the embodiment illustrated in FIG. 3, is that the air holes and polymer holes in the FIG. 15–20 embodiment exit at the apex 210, and that each polymer hole is flanked by air holes. Thus, referring to FIG. 15, a plurality of polymer holes 212–222 are spaced along apex 210, and are each flanked by two air holes in the following arrangement:

air holes 224 and 226 flank polymer hole 212;
air holes 228 and 230 flank polymer hole 214;
air holes 232 and 234 flank polymer hole 216;
air holes 236 and 238 flank polymer hole 218;
air holes 240 and 242 flank polymer hole 220;
air holes 244 and 246 flank polymer hole 222.

Countersunk bolt holes 248 receive bolts 50 for mounting the die tip 200 onto die body 16. As described in detail below, the polymer passage 32 of die body 16 (FIG. 2) delivers a polymer melt to the polymer holes 212 to 222 and air chamber 34 delivers air to the air holes 224–246.

Figure 16:
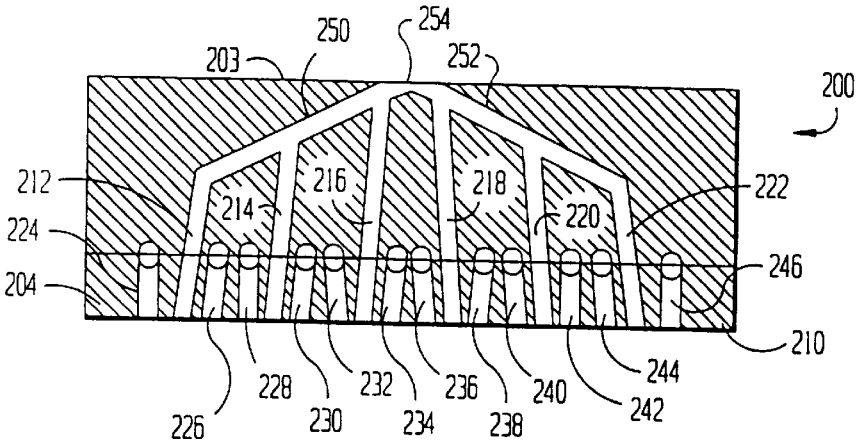
FIG. 16 is a sectional view of the die tip shown in FIG. 15 and taken generally along the apex through the longitudinal center of the die tip.

The polymer holes are best illustrated in FIG. 16. Two converging header passages 250 and 252 meet at near the center of mounting surface 203 at inlet 254.

The opposite and outermost polymer holess 212 and 222, respectively, extend from the ends of headers 250 and 252; inner polymer holes 214 and 216 junction with an inner section of header passage 250, and inner polymer holes 218 and 220 junction with an inner section of header passage 252.

The axes of the polymer holes 212–222, and polymer passages 250 and 252 all lie in the same plane which bisects the nosepiece along its length as illustrated in FIG. 15. The polymer passages may extend vertically in the defined plane (as illustrated in FIG. 5) but preferably taper outwardly with respect to the vertical. (Vertical is used herein as a reference direction for downward hot melt application to an underlying substrate. If the hot melt application is a different direction, this of course would be the reference direction for determining the taper angles of the polymer holes 212–222.)

The taper for the centermost polymer holes 216 and 218 may range from 0° to 4°, preferably 1° to 3° and the taper for each hole proceeding outward from the center may increase in increments by 1° to 4°, preferably 2° to 3°, as illustrated in FIG. 16.

As mentioned above, the air holes 224–246 are arranged in paired relationship with respect to an associated polymer holes. For example, polymer hole 224 is flanked by air holes 224 and 226. The other polymer holes are similarly flanked by two air holes.

Figure 18:
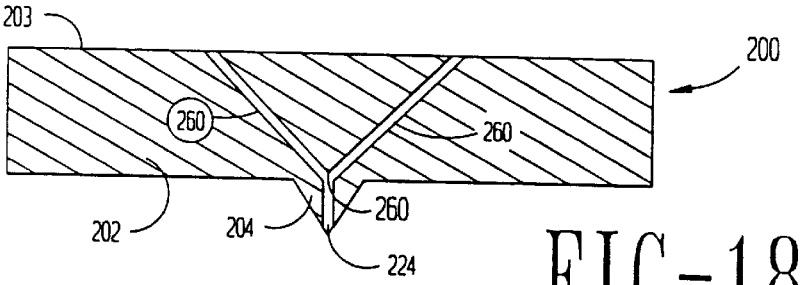
FIG. 18 is a sectional view of the die tip shown in FIG. 17 and taken along line 18—18 thereof.

As shown in FIG. 15, the outlets of the air holes 224–246 and polymer holes 212–222 are spaced along the apex 210 and all holes 212–246 extending through the nosepiece 204 lie in a row in the same plane. As best seen in FIG. 18 each air hole 224–246 is fed by converging air holes 256 and 258 which extend from the mounting surface 203 of die tip 200 and junction with each other and an air flow hole at 260. The converging air holes 256 and 258 extend from the base surface 203 and define an angle of between 70°–110° (not critical) and junction at 260 with air hole 224 within the base 202. The inlets of passages 256 and 258 align with chamber 34 with the die tip 200 mounted on die body 16 (FIG. 2), so that air from chamber 34 flows through holes 256 and 258, joining at 260 and through air hole 224.

Figure 17:
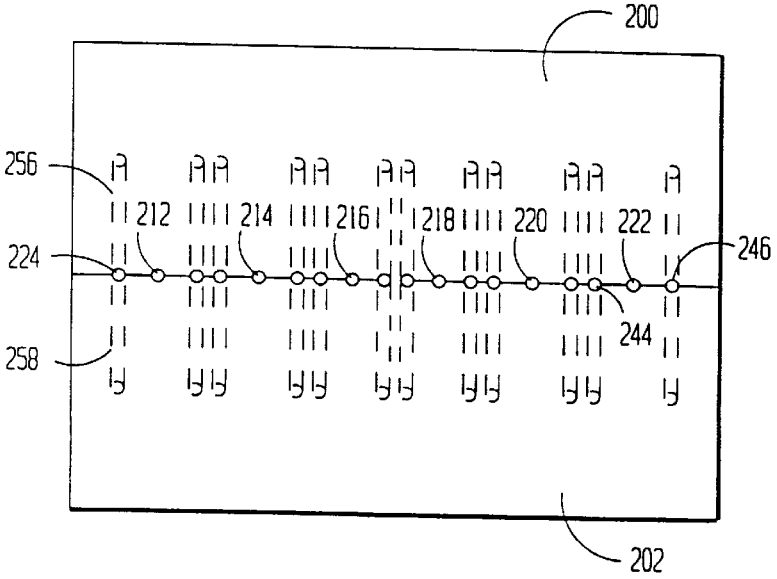
FIG. 17 is a top plan view of the die tip shown in FIG. 16 illustrating only the air passages.

The other air holes 226–246 similarly are fed by converging air passages that join at the inlet of each air hole. The converging air passages (e.g. 256 and 258) for each air hole (e.g. 224) may be identical and lie in a plane normal to the plane defined by the polymer holes 212–222, and may be parallel to one another as illustrated in FIG. 17.

The air holes 224–246 extending through the nosepiece 204, however, may have different orientation within the plane defined by the polymer holes 212–222 and air holes 224–246.

Each paired air holes (e.g. 224 and 226) may extend parallel to its associated polymer hole (e.g. 212). However, it is preferred that the flanking air holes (e.g. 224 and 226) converge slightly toward one another so that the air from each air hole intercepts the polymer filament discharged from the polymer hole therebetween a short distance below (e.g. ¼ to 2") the apex 210 (between about 25 to 75% of the die to collector distance).

The included angle between the axis of each polymer passage (e.g. 212) and each of its flanking air holes (e.g. 224 and 226) may range from 0° to 10°, preferably 2° to 8°, and most preferably 4° to 6°.

The embodiment illustrated in FIGS. 15 to 20 employs a pair of air holes for each polymer hole. Thus, except for the outer polymer holes 212 and 222, there will be two air holes between adjacent polymer holes. Although this is the preferred embodiment, it is within the scope of the present invention to use only one air hole between adjacent air passages. In this embodiment, the flow of air from each such air holes would contact and effect the polymer melt flow from adjacent polymer holes.

The air holes preferably are circular in cross section but may have other cross sectional shapes such as slots, ovals, and the like.

Assembly and Operation

A particularly advantageous feature of the present invention is that it permits the construction of a meltblowing die with a wide range of possible lengths using standard sized manifolds and interchangeable, self-contained modules and achieve uniform fiber deposition along the length of the modular die. Variable die length may be important for coating substrates of different sizes from one application to another. The following sizes and numbers are illustrative of the versatility of modular construction for the embodiments illustrated in FIGS. 1–9.

| Die Assembly | Broad Range | Preferred Range | Best Mode |
|---|---|---|---|
| Number of Modules | 3–6,000 | 5–100 | 10–50 |
| Length of Modules (inches) | 0.25–3.00" | 0.5–1.50" | 0.5–0.8" |
| Orifice Diameter (inches) | 0.005–0.050" | 0.01–0.040" | 0.015–0.030" |
| Orifices/Inch (for each module) | 1–50 | 4–40 | 4–20 |
| No air holes (57)/ Inch | 15–50 | 20–40 | 25–35 |
| No air holes (58)/ Inch | 15–50 | 20–40 | 25–35 |
| Air hole Diameter (inch) | 0.05–0.050 | 0.010–0.040 | 0.15–0.030 |
| No. Air hole/No. Orifices | 1–10 | 3–8 | 4–6 |

Depending on the desired length of the die, standard sized manifolds may be used. For example, a die length of one meter could employ 54 modules mounted on a manifold 40 inches long. For a 20 inch die length 27 modules would be mounted on a 20 inch manifold.

For increased versatility in the present design, the number of modules mounted on a standard manifold (e.g. one meter long) may be less than the number of module mounting places on the manifold. For example, FIG. 1 illustrates a die having a total capacity of 16 modules. If, however, the application calls for only 14 modules, two end stations may be sealed using plates 99A and 99B disposed sealingly over the stations and secured to the die manifold using bolts. Each plate will be provided with a gasket or other means for sealing the air passages 105, polymer passage 87, and instrument air passages 110 and 111.

The plates 99A or 99B may also be useful in the event a module requires cleaning or repair. In this case the station may be sealed and the die continue to operate while the module is being worked on.

The die assembly may also include electric heaters (not shown) and thermocouple (not shown) for heat control and other instruments. In addition, air supply line 107 may be equipped with an in-line electric or gas heater.

As indicated above, the modular die assembly can be tailored to meet the needs of a particular operation. In FIG. 1, 14 modules, each 0.74 inches in width, are mounted on a 13" long manifold. For illustrative purposes two end stations have been rendered inoperative using sealing plates 99A and 99B as has been described. The lines, instruments, and controls are connected and operation commenced. A hot melt adhesive is delivered to the die through line 97, hot air is delivered to the die through line 107, and instrument air or gas is delivered through lines 117 and 118.

Actuation of the control valves opens port 32 as described previously, causing polymer melt to flow though each module. The melt flows in parallel through manifold passages 87, through side ports 38, through passages 27, annular space, and through port 32 into the die tip via passage 67. The polymer melt is distributed laterally in passages 65 and 68 discharges through orifice 69 as side-by-side filaments 14. The air meanwhile flows from manifold passage 105 into port 39 through chamber 34, holes 57 and 58 discharging at air hole outlets 60. The converging air streams of air contact the fibers 14 discharging from the orifices 69 and by drag forces stretch them and deposit them onto an underlying substrate 15 in pattern. This forms a generally uniform layer of meltblown material on the substrate 15. The center air holes 57A and 58A are perpendicular to the apex so the air streams therefrom carry the filaments 14 directly to the substrate with no or little lateral flaring. However, the air streams discharging from the flanking air holes 57B and 58B converge upon the filaments 14 therebetween at an angle β (see FIG. 9). The angle β causes the filaments 14 to flare outwardly from the center of the die tip. The flaring is gradual from center to the outermost holes 57B depending on the value of angle β. As shown in FIG. 4, the outermost filaments 14 of each module 16 exhibit the greatest degree of flaring, with the inner filaments gradually showing an increase in the degree of flaring from center to opposite ends. Preferably the die is constructed so the filaments 14 deposited by one module is uniformly spaced with the filaments 14 deposited by its adjacent module or modules, with no, or very little overlapping.

Figure 14:
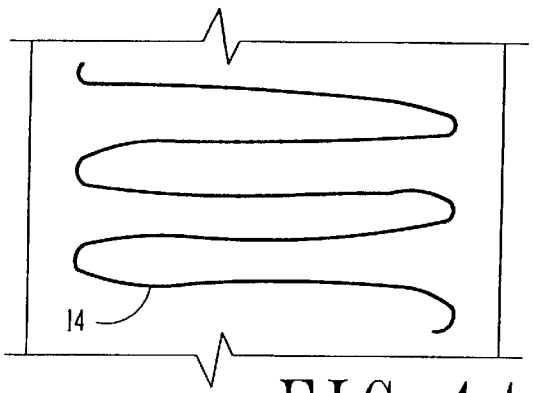
FIG. 14 is a top plan view of the sinusoidal pattern of a hot melt filament deposited on a substrate by the die shown in FIG. 11.

For the processing of hot melts using the die tip of FIGS. 13 and 14, the die body, manifold, and instrumentation and other associated equipment may be same as described above for the FIG. 1 embodiment. The die tip 113 however preferably should be constructed as follows:

| | Broad Range | Preferred Range | Best Mode |
|---|---|---|---|
| length air slits (164, 166) | 0.25–3" | 0.5–1.511 | 0.5–0.8" |
| included angle of air slits (164, 166) | 30–120 | 60–90 | 60 |
| taper of air slit side walls | 1°–25° | 5°–15° | 5°–10° |
| number of polymer holes/inch | 1–100 | 4–50 | 4–7 |

Typical operational parameters for processing hot melts are as follows:

| | |
|---|---|
| Polymer | Hot melt adhesive |
| Temperature of the Die and Polymer | 280° F. to 325° F. |
| Temperature of Air | 280° F. to 325° F. |
| Polymer Flow Rate | 0.1 to 10 gms/hole/min. |
| Hot Air Flow Rate | 0.1 to 2 SCFM/inch |
| Deposition | 0.05 to 500 g/m$^2$ |

As indicated above, the die assembly 10 may be used in meltblowing adhesives, spray coating resins, and web forming resins. The hot melt adhesives include EVA's (e.g. 20–40 wt % VA). These polymers generally have lower viscosities than those used in meltblown webs. Conventional hot melt adhesives useable include those disclosed in U.S. Pat. Nos. 4,497,941, 4,325,853, and 4,315,842, the disclosures of which are incorporated herein by reference. The above melt adhesives are by way of illustration only; other melt adhesives may also be used.

The typical meltblowing web forming resins include a wide range of polyolefins such as propylene and ethylene homopolymers and copolymers. Specific thermoplastics include ethylene acrylic copolymers, nylon, polyamides, polyesters, polystyrene, poly(methyl methacrylate), polytrifluoro-chloroethylene, polyurethanes, polycarbonates, silicon sulfide, and poly(ethylene terephthalate), pitch and blends of the above. The preferred resin is polypropylene. The above list is not intended to be limiting, as new and improved meltblowing thermoplastic resins continue to be developed.

Polymers used in coating may be the same used in meltblowing webs but at somewhat lower viscosities. Meltblowing resins for a particular application can readily be selected by those skilled in the art.

In meltblowing resins to form webs and composites, the die assemble 10 is connected to a conventional extruder or polymer melt delivery system such as that disclosed in U.S. Pat. No. 5,061,170, the disclosure of which is incorporated herein by reference.

The embodiment of the die tip described in FIG. 15 is particularly adapted to the processing of hot melt adhesives to achieve the sinusoidal, stitch-like deposition pattern (e.g. a repeating wave pattern). The preferred design parameter for the assembly equipped with the die tip of FIG. 15 are presented below.

| | Broad Rnnge | Preferred Range | Best Mode |
|---|---|---|---|
| number modules | 3–6000 | 5–100 | 10–50 |
| length of each module (in) | 0.25"–3" | 0.5"–1.50" | 0.5"-0.8" |
| polymer holes | | | |
| number | 2–100 | 2–30 | 2–10 |
| size (diam., mm) | .005"–.050" | .01"–.04" | .015"–.030" |
| spacing (holes per inch) | 1–50 | Π 4–40 | 5–20 |
| number per module | 1–50 | 4–40 | 5–20 |
| incremental outward taper angle between adjacent polymer holes | 1°–10° | 1°–5° | 2°–3° |
| distance (die-to-collector) air holes | 0.25–4 | 0.5–2 | 0.75–1 ½ |
| number for each polymer hole | 1–2 | 1–2 | 1–2 |
| size (diam., mm) | .005"–.05" | .01"–.04" | .015"–.03" |
| angle relative to polymer hole | 1°–10° | 1°–7° | 2°–5° |

-continued

| | Broad Rnnge | Preferred Range | Best Mode |
|---|---|---|---|
| spacing from associated polymer hole (axis to axis mm) | .005"–.05" | .01"–.05" | .01"–.02" |

(The specification ranges recited herein are interchangeable. For example, the polymer hole per inch range includes 1–20, and diameter includes 0.005–0.30 mm.)

The operating parameters for the FIG. 15 embodiment may be as follows:

| | Broad Range | Preferred Range | Best Mode |
|---|---|---|---|
| Die Temp. (° F.) | 70–700° | 220°–400° | 300°–350° |
| Flow rate (gr/hole/min) | 0.01–300 | 0.1–100 | 0.2–80 |
| Air temp. | 70°–700° | 220°–400° | 300°–350° |
| Air flow rate SCFM/gram/hole | .001–.008 | .001–.006 | .002–.005 |
| Filament size leaving die (micron) | 5–500 | 10–300 | 50–200 |
| Filament size deposited on substrate (micron) | 5–500 | 10–300 | 50–200 |
| Line speed | 5–2000 FPM | 10–1500 FPM | 500–1500 FPM |

The operation of the die assembly 10 equipped with the die tip of FIG. 1–9 is illustrated in FIGS. 10 and 11. The filaments 14A–L are discharged from each polymer hole 69 and are contacted by hot air from flanking air holes 57, 58. The aerodynamic, drag, and lift forces causes each filament 14A–L to oscillate which has a transverse direction component. The filaments 14 are deposited in a side-by-side sinusoidal wave-like pattern. The edges may overlap slightly as illustrated. Pattern 14A overlaps 14B shown in dashes. The sinusoidal pattern for each filament will be continuous on the substrate 15. For convenience of illustration, only 14A and 14B are shown as continuous. However, operating conditions may be controlled to avoid overlapping if desired. (Air rate, polymer rate, and line speed, and die tip distance can be varied to give the desired pattern.) Typically the sinusoidal pattern of each filament will have a frequency of 2 to 50 stitches per inch, preferably 10 to 20 stitches per inch. (A stitch represents ½ cycle of the wave.) The amplitude of the wave (end-to-end TD) typically be from 1 to 25 mm, preferably 1 to 6 mm.

The operation of a die assembly equipped with the die tip 113 is illustrated in FIGS. 13 and 14. The die tip with one polymer hole 174 discharges hot melt filament 100 into the converging sheets of hot air emerging from air slits 164 and 166. The drag and lift forces causes the filament 14 to oscillate in both the transverse and machine direction. The filament 14 is deposited on the substrate in a sinusoidal pattern as illustrated in FIG. 14.

Figure 19:
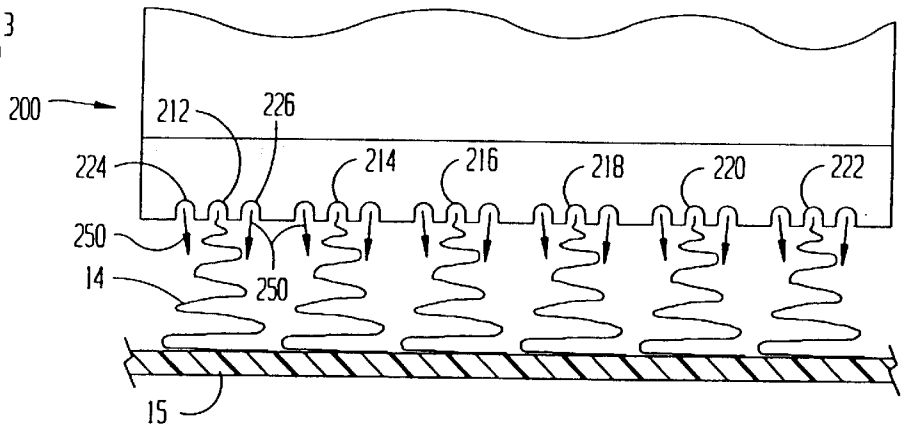
FIG. 19 is a side elevation of the die tip illustrated in FIG. 12 showing the deposition of hot melt filaments onto a substrate.

The operation of the die assembly 10 equipped with die tips 200 of the embodiment shown in FIG. 15 is illustrated in FIGS. 19 and 20.

Hot melt filaments 14 are discharged from polymer holes 212–222 and are contacted by air discharged from flanking air passages (e.g. 224 and 226). The filaments 14 are deposited on the substrate 15 in side-by-side sinusoidal, stitch-like pattern. The frequency, amplitude, and diameter of the filaments may be controlled by varying line speed, hot melt and air throughout operating temperatures, grade of hot melt, die distances from substrate, air passage orientation.

EXAMPLES

Example I

Two identical side-by-side modules were constructed having the following dimensions (the side-by-side modules are illustrated in FIG. 10):

| | |
|---|---|
| Die Tip Width: | 0.740 inches |
| Polymer Orifices | |
| Number: | 6 |
| Diameter: | 0.02 inches |
| Center-to-Center: | 1.04 inches |
| Apex Length Between Orifices: | 0.100 inches |
| Air Holes | |
| Diameter: | 0.02 inches |
| Number Per Side: | 17 |
| Angle: (α) | 60° |
| Incremental Angle: | 1° |
| Spacing: | 27 per inch |
| Nosepiece | |
| Apex Height From Base: | 0.088 inches |

The two-module die was operated at the following conditions:

| | |
|---|---|
| Polymer: | Hot Melt Adhesive |
| Polymer Melt Temp.: | 270° F. |
| Air Temp.: | 280° F. |
| Polymer Flow Rate: | 1.66 gr/hole/min. |
| Air Flow Rate: | 0.55 SCFM |
| Line Speed: | 1000 FPM |

The adhesive filaments were deposited on a substrate in a generally uniform sinusoidal wave pattern with very little overlapping. The width (TD) of the adhesive pattern produced by the side-by-side module was approximately 1.5 inches even through the total length of the row of orifices of the side-by-side modules was only 1.248 inches. The pattern was uniform even across the space between the two modules. The lateral deposition of the adhesive from each module was 0.750 inches from a row of orifices 0.52 inches long. The sinusoidal pattern is illustrated in FIG. 11.

Example II

A die tip with air plates illustrated in FIG. 13 was constructed having the following dimensions:

| | |
|---|---|
| Die tip width (along the apex) | 0.74" |
| Polymer Orifices | |
| number | 1 |
| diameter | 0.02" |
| Air Plates | |
| slit opening | 0.007" |
| end wall angle | 8° |

The die was operated at the following conditions

| | |
|---|---|
| Polymer | hot melt adhesives |
| Polymer melt temp. | 270° F. |
| Air temp. | 280° F. |
| Polymer flow rate | 20 g/h/m |
| Air flow rate | 0.8 SCFM |
| Line speed | 1000 FPM |

As illustrated in FIG. 14, the filament 14 was deposited on the substrate in large sinusoidal pattern having a frequency of 18 and an amplitude of 0.375".

Example III

A die equipped with a die tip illustrated in FIG. 15 was constructed and tested. The die tip had the following dimension:

| | |
|---|---|
| Die tip width | 0.74" inches |
| Polymer holes | |
| number | 6 |
| diameter | 0.02" |
| outward taper | |
| 2 outer holes | 8° |
| 2 middle holes | 5° |
| 2 inner holes | 3° |
| Air holes | |
| number | 12 (2 for each polymer holes) |
| diameter | 0.02" |
| inward taper of each air hole axis rel. polymer hole | 5° |
| spacing (air hole axis from polymer hole axis) along apex | 0.010" |

The die was operated at the following conditions

| | |
|---|---|
| Polymer | Hot melt adhesive |
| Polymer melt temp. | 270° F. |
| Air temp. | 280° F. |
| Polymer flow rate | 5 gr/hole/min |
| Air flow rate | 0.4 SCFM |
| Line speed | 1000 FPM |

As illustrated in FIGS. 19 and 20, the hot melt adhesives filaments 14 discharging from each polymer hole (e.g. 212) were contacted by flanking air streams 250 from air holes (e.g. 224 and 226). The filaments oscillated as illustrated and were deposited on substrate 15 in side-by-side sinusoidal pattern of filaments 14.

The filament patterns were overlapping but exhibited good edge control with little space between adjacent filaments 14. As noted above, the spacing can be varied from overlapping to wider spacing by changing the operating condition of the die assembly.

What is claimed is:

1. A meltblowing system for depositing a plurality of filaments onto a moving substrate or collector, comprising:

a meltblowing die having (i) a die body; and (ii) a die tip mounted on the die body and having (a) a row of fiber discharge orifices formed therein along a width of said die tip, said row of fiber discharge orifices being adapted to discharge a row of molten thermoplastic filaments therefrom, and deposit the same onto the moving substrate or collector in a pattern thereon, and (b) two rows of air passages with each row of air passages positioned on an opposite side of said row of fiber discharge orifices, said two rows of air passages including respective center air passages positioned on opposite sides of said row of fiber discharge orifices and additional air passages positioned outwardly from the center air passages, said additional air passages angling outwardly in opposite directions along the width of said die tip such that air discharged from said additional air passages causes the filament pattern deposited onto the substrate or collector to have a lateral dimension larger than the length of the row of fiber discharge orifices.

2. A meltblowing system for depositing a plurality of filaments onto a moving substrate or collector, comprising:

a meltblowing die having a die body; and a die tip mounted on the die body and having (a) a row of fiber discharge orifices formed therein, said row of fiber discharge orifices being adapted to discharge a row of molten thermoplastic filaments therefrom, and deposit the same onto the moving substrate or collector in a pattern thereon, and (b) two rows of air holes flanking the row of fiber discharge orifices to discharge air therefrom to contact the thermoplastic filaments to cause at least some of the filaments to flare outwardly from the center of the row of fiber discharge orifices, each row of air holes having at least one center air hole which lies in a plane perpendicular to the row of fiber discharge orifices and other air holes positioned outwardly from the center air hole that angle outwardly from the plane perpendicular to the row of fiber discharge orifices, whereby the filament pattern deposited onto the substrate or collector has a lateral dimension larger than the length of the row of fiber discharge orifices.

3. A meltblowing system for depositing a plurality of filaments onto a moving substrate or collector, comprising:

a plurality of side-by-side die modules, each die module having a die body; and a die tip mounted on the die body and having (a) a row of fiber discharge orifices formed therein along a width of said die tip, said row of fiber discharge orifices being adapted to discharge a row of molten thermoplastic filaments therefrom, and deposit the same onto the moving substrate or collector in a pattern thereon, and (b) two rows of air passages with each row of air passages positioned on an opposite side of said row of fiber discharge orifices, said two rows of air passages including respective center air passages positioned on opposite sides of said row of fiber discharge orifices and additional air passages positioned outwardly from the center air passages, said additional air passages angling outwardly in opposite directions along the width of said die tip such that air discharged from said additional air passages causes the filaments deposited by one die module to be generally uniformly spaced with filaments deposited by an adjacent die module.

* * * * *